United States Patent [19]

Hare

[11] 4,019,746

[45] Apr. 26, 1977

[54] SET OF GAME PIECES

[76] Inventor: Herbert K. Hare, R.F.D. No. 1, Box 90, Hillsboro, N.H. 03244

[22] Filed: May 19, 1976

[21] Appl. No.: 688,072

[52] U.S. Cl. ..... 273/137 AB; 273/131 KC; 273/137 F

[51] Int. Cl.[2] ..... A63F 3/02

[58] Field of Search ... 273/136 E, 137 AB, 137 AC, 273/137 AD, 137 F, 137 R, 130 AC, 131 AC, 131 KC, 131 K

[56] References Cited

UNITED STATES PATENTS

| | | | |
|---|---|---|---|
| 1,623,881 | 4/1927 | Mayer | 273/137 F |
| 2,196,861 | 4/1940 | Gruber | 273/136 E |
| 3,520,537 | 7/1970 | Peebles | 273/136 E |

FOREIGN PATENTS OR APPLICATIONS

| | | | |
|---|---|---|---|
| 16,560 | 5/1905 | United Kingdom | 273/137 F |
| 20,002 | 4/1915 | United Kingdom | 273/137 F |

*Primary Examiner*—Anton O. Oechsle
*Assistant Examiner*—Harry G. Strappello
*Attorney, Agent, or Firm*—Robert D. Farkas

[57] ABSTRACT

This disclosure pertains to a modified checker game apparatus utilizing a conventional playing board in combination with two sets of playing pieces, including playing pieces having a cavity portion in the uppermost lateral surface thereof. A piggy-back type add-on playing piece attachment is removably and partially fitted within the cavity, providing thereby increased versatility in the game rules involving the game of checkers. Stacking structure is provided so that the cavity equipped playing pieces may be nested, one above the other, upon the removal of the add-on playing piece attachment from the lowermost playing piece.

5 Claims, 3 Drawing Figures

SET OF GAME PIECES

BACKGROUND OF THE INVENTION

1. The Field of the Invention

This invention relates to game apparatus and more particularly to that class utilized in the game of checkers employing separable playing pieces with attachment thereto.

2. Description of the Prior Art

The prior art abounds with game apparatus utilizing separable attachements. U.S. Pat. No. 1,268,659 issued on June 4, 1918 to J. L. Wright teaches a modified checker game employing game pieces sensibly shaped to resemble hobby horses and attachments thereto in the form of "horsemen" that may be removably attached to the playing pieces.

U.S. Pat. No. 1,623,881 issued on Apr. 5, 1927 to J. Mayer discloses a game utilizing a diamond shaped field divided into a plurality of alternate colored diamond shaped playing positions and employing various shaped attachments adapted for the removable fastening to individual playing pieces.

U.S. Pat. No. 3,186,716 issued on June 1, 1965 to A. A. Shabaric pertains to a conventional checker board playing area utilized in combination with two sets of playing pieces. Each playing piece is adapted with a circular or rectangularly shaped cavity extending through the lowermost lateral surface thereof. A circular or rectangular shaped protrusion extends upwardly from the uppermost lateral surface of each playing piece. The shape of the cavity need not, but may match the shape of the protrusion, thereby providing for an interesting set of game playing rules of greater complexity than the conventional checker game.

All of the aforementioned patents suffer the common deficiency in that the ability to stack pieces, other than in a proscribed limited fashion as in Shabaric, is lost. Furthermore, the cost of manufacture for such complicated pieces and attachments where used, is high and tends to limit the sales potential of the apparatus.

SUMMARY OF THE INVENTION

A primary object of the present invention is to provide a removable attachment for a checker playing piece so as to increase the flexibility and variations in the game rules above and beyond that of conventional checkers.

Another object of the present invention is to provide a checker playing piece which can be used in conventional fashion and by the addition of an attachment thereto, provides utility, in accordance with an interesting variation in the game rules.

Still another object of the present invention is to provide an inexpensive checker game playing piece and an inexpensive removable attachment therefor.

Yet another object of the present invention is to provide a checker playing piece which may be stacked one to another.

Checkers, though a time honored competitive game, lacks complexity and fails to retain the player's interest due to the simplistic competitive game rules employed therein. Popularity of the game, however, is maintained due to the inexpensive costs of manufacture.

The present invention, though providing an attachment piece in addition to a modified playing piece, yields an apparatus whose cost of manufacture is roughly equivalent to the cost of manufacture of a conventional checker game apparatus whilst providing a game which inherently possesses the ability to enhance player interest for prolonged periods of time.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a checker game playing piece having a cylindrical exterior wall surface and a pair of opposed lateral surfaces disposed adjacent the opposite ends of the walls. An uppermost lateral surface contains a circular cross-sectional cavity centrally located therein, having a base portion disposed intermediate the pair of lateral surfaces. A circumferential notch is located intermediate the uppermost portion of the side wall and the outermost portion of the uppermost lateral surface. A lowermost cavity is formed in the lowermost lateral surface having a substantially circular marginal edge, adapted to receive therein the uppermost lateral surface of another playing piece, thereby enabling the playing pieces to be stacked or nested in pairs in the fashion commonly used to denote "Kings". The playing pieces are divided into two sets of twelve pieces each, wherein each set is markedly distinguishable from the other.

A circular disc having a thickness exceeding the depth of the cavity in the uppermost lateral surface and a smaller diameter than the diameter of the uppermost cavity is utilized as an attachment, or rider piece, removably installed in the uppermost cavity of the playing piece. There are twenty-four such attachment pieces. The game rules are modified, because of the presence of the attachment, so as to include the possibility that a playing piece may be "jumped" more than once before removal from the board. At the onset of a game, each playing piece is fitted with an attachment. On first being jumped, the attachment is removed signifying vulnerability for a succeeding jump, at which time the playing piece is removed from the board. Playing pieces which do not bear attachments may approach a back row, and upon being jumped by an opponent's playing piece emanating from the back row, are removed from the game. Contrari-wise, playing pieces bearing an attachment, upon arrival at a row adjacent an opponent's back row, forces the opponent's back row piece to jump the threatening player piece and attachment. At this point, the attachment is removed, and the unadorned threatening piece is free to move into the opponent's back row and be kinged. Any playing piece successfully arriving at an opponent's back row bearing an attachment, is made a "King" after the removal of the attachment. Thus, the game of checkers is made more interesting and challenging by the simple addition of removable attachments and stacking capabilities amongst the individual playing pieces.

Figure 1:
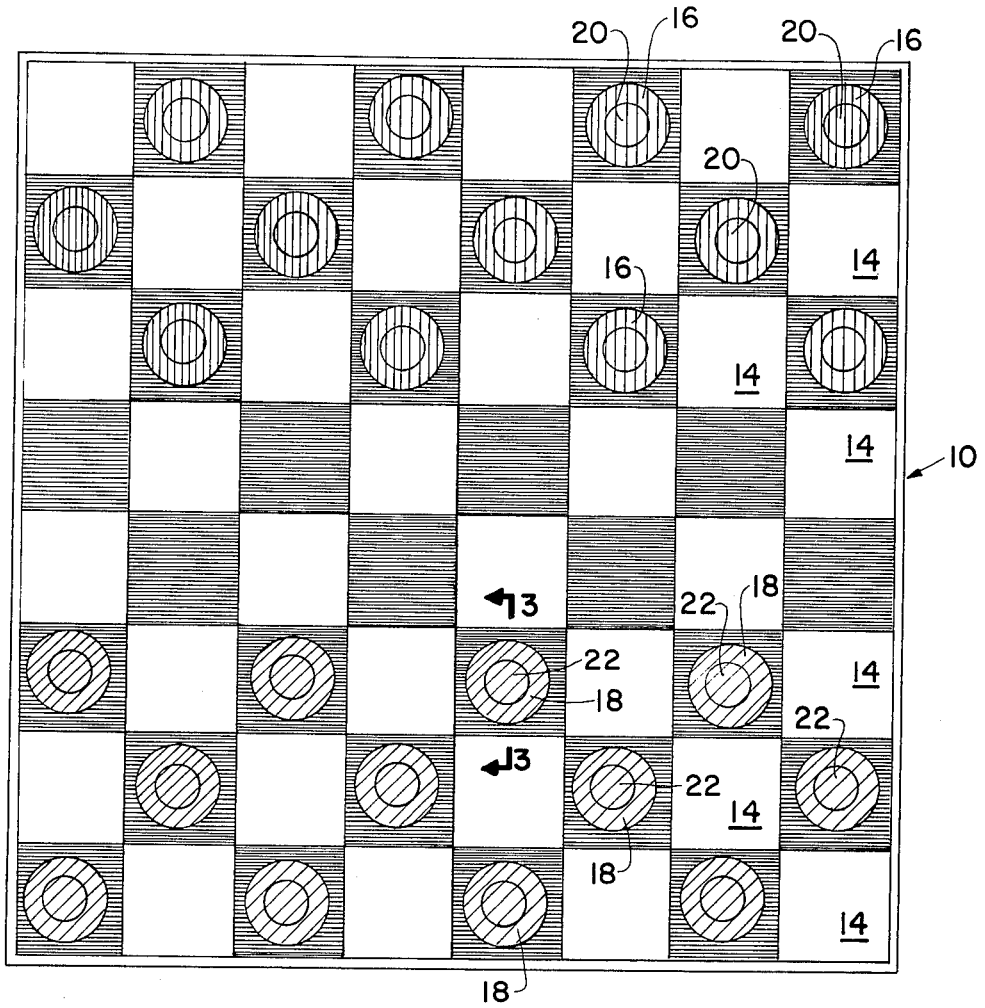
FIG. 1 is a plan view of a checker board playing field and two sets of checker playing pieces and attachments thereto residing thereon.

Now referring to the Figures, and more particularly to the embodiment illustrated in FIG. 1 showing a checker board playing field 10 having alternate playing squares 12 differently colored from adjacent alternate playing squares 14. One set of circular playing pieces 16 are shown having a different color than another set of circular playing pieces 18. Circular attachments 20 are carried by playing pieces 16. Circular attachments 22 are carried by playing pieces 18. The set of playing pieces, denoted by numeral 16, and the set of opposing playing pieces, denoted by numeral 18, and attachments 20 and 22 fitted thereto respectively, are shown in the game starting position, all residing on squares denoted by the numeral 12. Attachments 20 and 22 may be similarly colored though different in color from either playing pieces 16 or 18, or, if desired, may be of the same color as the playing piece to which they are attached.

Figure 2:
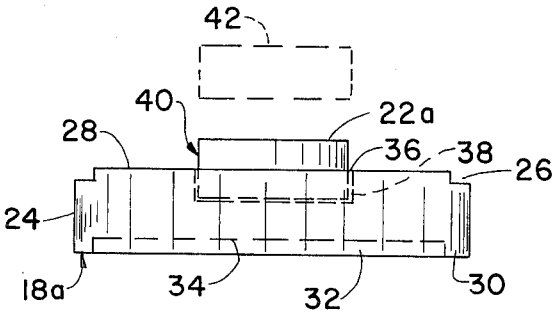
FIG. 2 is a side elevation view of a checker playing piece and attachment.

FIG. 2 illustrates playing piece **18*a* having a cylindrical side wall 24. Cylindrical notch 26 is shown intermediate the uppermost portions of side wall 24 and the uppermost cylindrical lateral surface 28. Lowermost lateral surface 30 contains a disc-like cavity 32, defined by dotted lines 34. The uppermost lateral surface 28 similarly contains a cylindrical cavity 36 shown defined by dotted lines 38. Attachment 22*a* having cylindrical side walls 40, is shown partially extending outwardly and upwardly from the uppermost lateral surface 28. Dotted lines 42 denote attachment 22*a* when it has been removed from partial confinement within cavity 36.**

Figure 3:
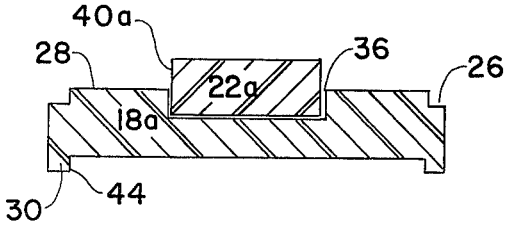
FIG. 3 is a cross-sectional side elevation view taken along line 3—3 viewed in the direction of arrows 3—3 as shown in FIG. 2 illustrating a cross-section of the individual playing piece and attachment thereof.

FIG. 3 illustrates attachment **22*a* installed within cavity 36 centrally disposed in uppermost lateral surface 28 of playing piece 18*a*. Rim 44 comprising lateral surface 30 is capable of fitting within shoulder 26 of another playing piece having similar features and constructional details. Exposed wall portion 40*a* facilitates the simple removal of attachment 22*a* from cavity 36.**

One of the advantage of the present invention is a removable attachment for a checker playing piece so as to increase the flexibility and variations in the game rules above and beyond that of conventional checkers.

Another advantage of the present invention is a checker playing piece which can be used in conventional fashion and by the addition of an attachment thereto, provide utility, in accordance with an interesting variation in the game rules.

Still another advantage of the present invention is an inexpensive checker game playing piece and an inexpensive removable attachment therefor.

Yet another advantage of the present invention is a checker playing piece which may be stacked one to another.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A game comprising two sets of playing pieces, each of the playing pieces comprising one of said two sets being variantly colored from each of the playing pieces comprising the other of said two sets, a plurality of attachment pieces, each of said plurality of attachment pieces being removably engaged within a first cavity in a first lateral surface in the playing pieces of said one of said two sets and in the playing pieces of said other of said two sets, stacking means for stacking a first of said playing pieces to a second of said playing pieces, said second of said playing pieces being disposed above said first of said playing pieces when said each of said plurality of attachment pieces are removed from said first cavity disposed within said first lateral surface of said first of said playing pieces, said first cavity residing at the center of said first lateral surface, said first lateral surface bounded by a circular marginal edge, a playing piece wall, said playing piece wall substantially defining a cylindrical surface and normal to said first lateral surface, the lowermost marginal edge of said playing piece wall defining a second lateral surface, said each of said plurality of attachment pieces having a disc-like shape, the thickness of said disc-like shape being greater than the depth of said first cavity, the diameter of said first cavity being greater than the diameter of said disc-like shape.

2. The game as claimed in claim 1 wherein said stacking means comprises a circumferential notch, said circumferential notch being disposed intermediate said marginal edges of said first lateral surface and the uppermost edge of said playing piece wall, said uppermost edge of said playing piece wall being disposed intermediate said first lateral surface and said second lateral surface, a second circular cavity being disposed within said second lateral surface, said second circular cavity having a greater diameter than the diameter of said marginal edges of said first lateral surface, a plane, said plane passing through said first lateral surface, said second circular cavity having a depth greater than the distance separating said plane and said uppermost edge of said playing piece wall.

3. The game as claimed in claim 1 wherein said plurality of attachment pieces are variantly colored from the colors of said one of said two sets and the other color of said other of said two sets.

4. The game as claimed in claim 3 wherein a sub-plurality of said plurality of attachment pieces are similarly colored to said color of said one of said two sets and the remainder of said plurality of attachment pieces are similarly colored to said other color of said other of said two sets.

5. The game as claimed in claim 1 wherein each of said two sets comprise twelve individual playing pieces, each of said twelve individual playing pieces having one of said plurality of attachment pieces removably affixed thereto.

* * * * *